US011986717B2

(12) United States Patent
Schultz

(10) Patent No.: US 11,986,717 B2
(45) Date of Patent: May 21, 2024

(54) PORTABLE PITCHING MOUND

(71) Applicant: True Pitch, Inc., Altoona, IA (US)

(72) Inventor: Randy Schultz, Sumner, IA (US)

(73) Assignee: True Pitch, Inc., Altoona, IA (US)

( * ) Notice: Subject to any disclaimer, the term of this patent is extended or adjusted under 35 U.S.C. 154(b) by 98 days.

(21) Appl. No.: 17/694,157

(22) Filed: Mar. 14, 2022

(65) Prior Publication Data

US 2022/0193521 A1 Jun. 23, 2022

Related U.S. Application Data

(63) Continuation-in-part of application No. 16/916,416, filed on Jun. 30, 2020, now Pat. No. 11,291,904, which is a continuation-in-part of application No. 16/853,094, filed on Apr. 20, 2020, now abandoned, which is a continuation of application No. 16/039,539, filed on Jul. 19, 2018, now abandoned.

(51) Int. Cl.
*A63B 71/00* (2006.01)
*A63B 71/02* (2006.01)

(52) U.S. Cl.
CPC ..... *A63B 71/02* (2013.01); *A63B 2210/50* (2013.01)

(58) Field of Classification Search
CPC ..... A63B 71/02; A63B 2210/50
USPC ..... 473/497
See application file for complete search history.

(56) References Cited

U.S. PATENT DOCUMENTS

| | | | | | |
|---|---|---|---|---|---|
| 3,703,285 | A * | 11/1972 | Perry | A63B 69/0013 | 473/497 |
| 4,925,186 | A * | 5/1990 | Stevenson | A63B 69/0002 | 473/497 |
| 5,058,889 | A * | 10/1991 | Burton | A63B 69/0002 | 473/499 |
| 5,213,323 | A * | 5/1993 | Novinsky | A63B 69/0002 | 473/497 |
| 9,474,954 | B2 * | 10/2016 | Lee | A63B 69/0013 | 473/497 |
| 11,000,748 | B1 * | 5/2021 | Krystosek | A63B 69/0002 | 473/497 |
| 11,291,904 | B2 * | 4/2022 | Schultz | A63B 69/0002 | 473/497 |
| 2022/0331677 | A1 * | 10/2022 | Hagerty | A63B 69/0013 | 473/497 |

* cited by examiner

*Primary Examiner* — Mitra Aryanpour
(74) *Attorney, Agent, or Firm* — ZarleyConley PLC

(57) ABSTRACT

A portable pitching mound with a plurality of mound sections. The plurality of mound sections are assembled by inserting a lower edge of one mound section into a receiving slot of another mound section. The configuration of the receiving slot forms an opening larger than the lower edge of the mound section to be received therein. The larger size of the opening allows the lower edge to be positioned anywhere above the opening of the receiving slot and upon lowering the weight of the mound section and gravity causes the lower edge to slide downwards and towards the adjoining mound section. Assembly does not require any tools or connection members such as screws, bolts, clamps, clasps, pins, adherent or adhesive surfaces, or the like.

10 Claims, 8 Drawing Sheets

PORTABLE PITCHING MOUND

CROSS REFERENCE TO RELATED APPLICATION

This application is a continuation-in-part of U.S. application Ser. No. 16/916,416 filed Jun. 30, 2020, which is a continuation-in-part of abandoned U.S. application Ser. No. 16/853,094 filed on Apr. 20, 2020, which is a continuation of abandoned U.S. application Ser. No. 16/039,539 filed on Jul. 19, 2018, the contents of these applications are hereby incorporated by reference in their entirety.

BACKGROUND OF THE INVENTION

The present invention is directed to a portable pitching mound, and more particularly, to a portable pitching mound having multiple mound sections that are easy to assemble.

Portable pitching mounds are known in the art. Larger pitching mounds, due to their size and weight, include multiple mound sections that are connected to one another. There are a number of ways that the mound sections are connected to one another. Unfortunately, these connections mean the mounds are complex, expensive to manufacture, or difficult to assemble. Accordingly, a need exists in the art for a device that addresses these deficiencies.

An objective of the present invention is to provide a portable pitching mound that is easy to assemble.

Another objective of the present invention is to provide a portable pitching mound having a connecting means that is easy and inexpensive to manufacture.

These and other objectives will be apparent to those having ordinary skill in the art based upon the following written description, drawings and claims.

SUMMARY OF THE INVENTION

A portable pitching mound having a plurality of mound sections. The mound sections have an outer edge, a top surface, and at least one inner or side wall having a lower edge.

The plurality of mound sections are assembled by inserting a lower edge of one mound section into a receiving slot of another mound section. The configuration of the receiving slot forms an opening larger than the lower edge of the mound section to be received therein. The larger size of the opening allows the lower edge to be positioned anywhere above the opening of the receiving slot and upon lowering, the weight of the mound section and gravity causes the lower edge to slide downwards and towards the adjoining mound section. Assembly does not require any tools or connection members such as screws, bolts, clamps, clasps, pins, adherent or adhesive surfaces, or the like.

DETAILED DESCRIPTION

Figure 1:
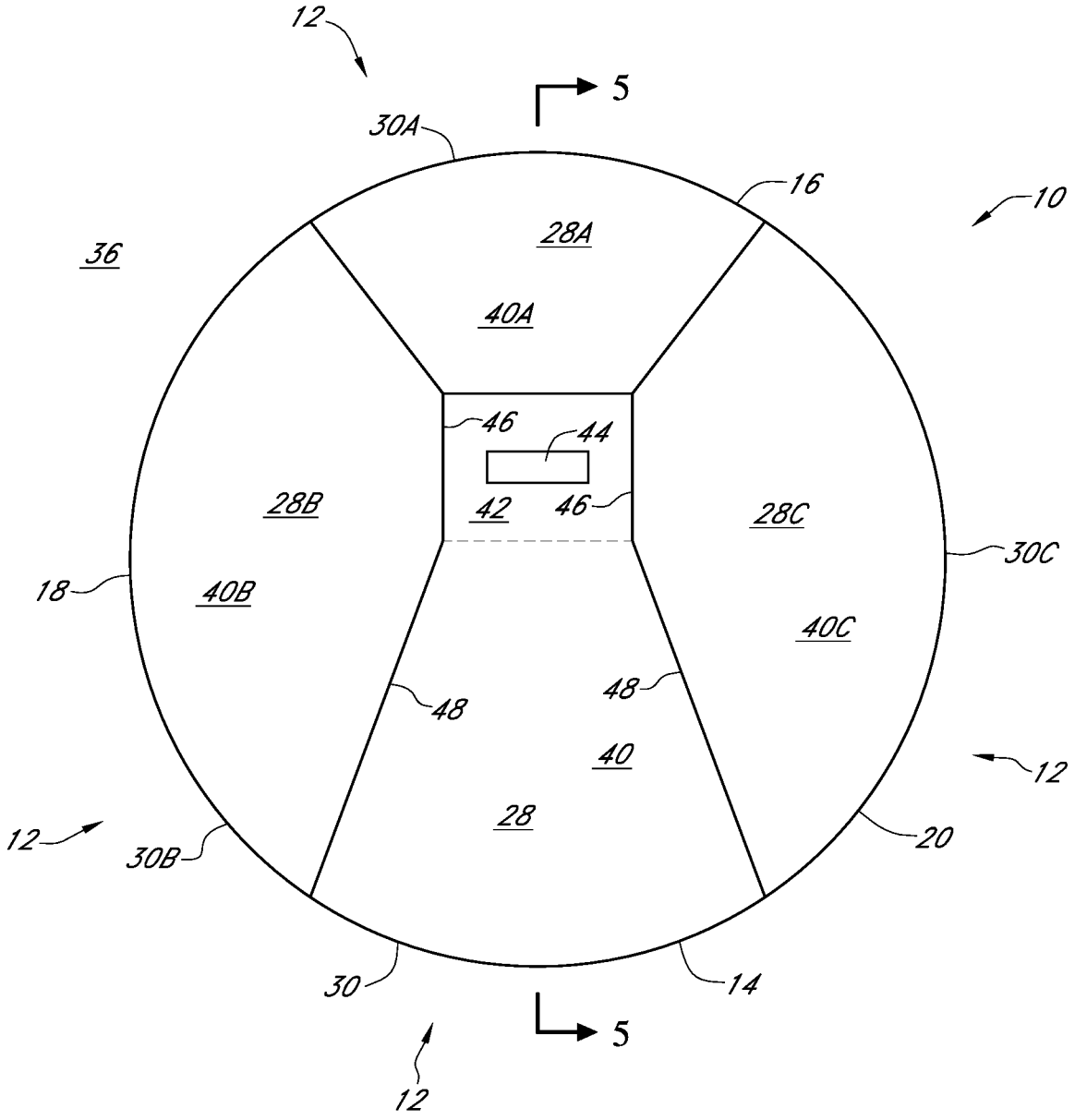
FIG. 1 is a top plan view of a portable pitching mound.

With reference to the Figures, a portable pitching mound 10 includes a plurality of mound sections 12 that are removably connected to one another, including, for example, a first section or first central section 14, a second section or second central section 16, a third section or first side section 18, and a fourth section or second side section 20. The portable pitching mound 10 may have any number of mound sections as depicted in the exemplary embodiments of the present invention showing the portable pitching mound 10 having four mound sections 12 and three mound sections 12. Alternatively, the portable pitching mound 10 could comprise one, two, three, four, five, or even more mound sections 12.

The plurality of mound sections 12 are assembled and connected to form the portable pitching mound 10 by inserting a lower edge 22 of one mound section 12 into a receiving slot or channel 24 that extends upwardly and outwardly from the lower edge 22 of another mound section 12. The upward and outward extension of the receiving slot 24 forms an opening 26 that is larger than the lower edge 22 of the mound section 12 to be received therein. The larger size of the opening 26 permits the lower edge 22 of one mound section 12 to be positioned anywhere above the opening 26 of the receiving slot 24 and upon lowering the lower edge 22 of one mound section 12 into the receiving slot 24, the angle of the receiving slot 24 causes a simple assembly and secure connection between adjacent mound sections 12 due to the weight of the mound sections 12 and gravity that forces the mound sections 12 together as the lower edge 22 of one mound section 12 slides towards the lower edge 22 having the receiving slot 24. In some embodiments, the receiving slot 24 extends around the entire lower edge 22 of at least one mound section 12 which assembles with other mound sections 12 that only terminate in the lower edge 22. In other arrangements, the receiving slot 24 only partially extends around the lower edge 22 of one or more mound sections 12.

Assembly of the portable pitching mound 10 does not require any connection members (not shown) such as screws, bolts, clamps, clasps, pins, adherent or adhesive surfaces, or the like. Rather, assembly is accomplished by the insertion of a lower edge 22 into a receiving slot 24 of the respective plurality of mound sections 12. Without limitation, various particular exemplary embodiments of the present invention will be discussed further in the following.

Figure 2:
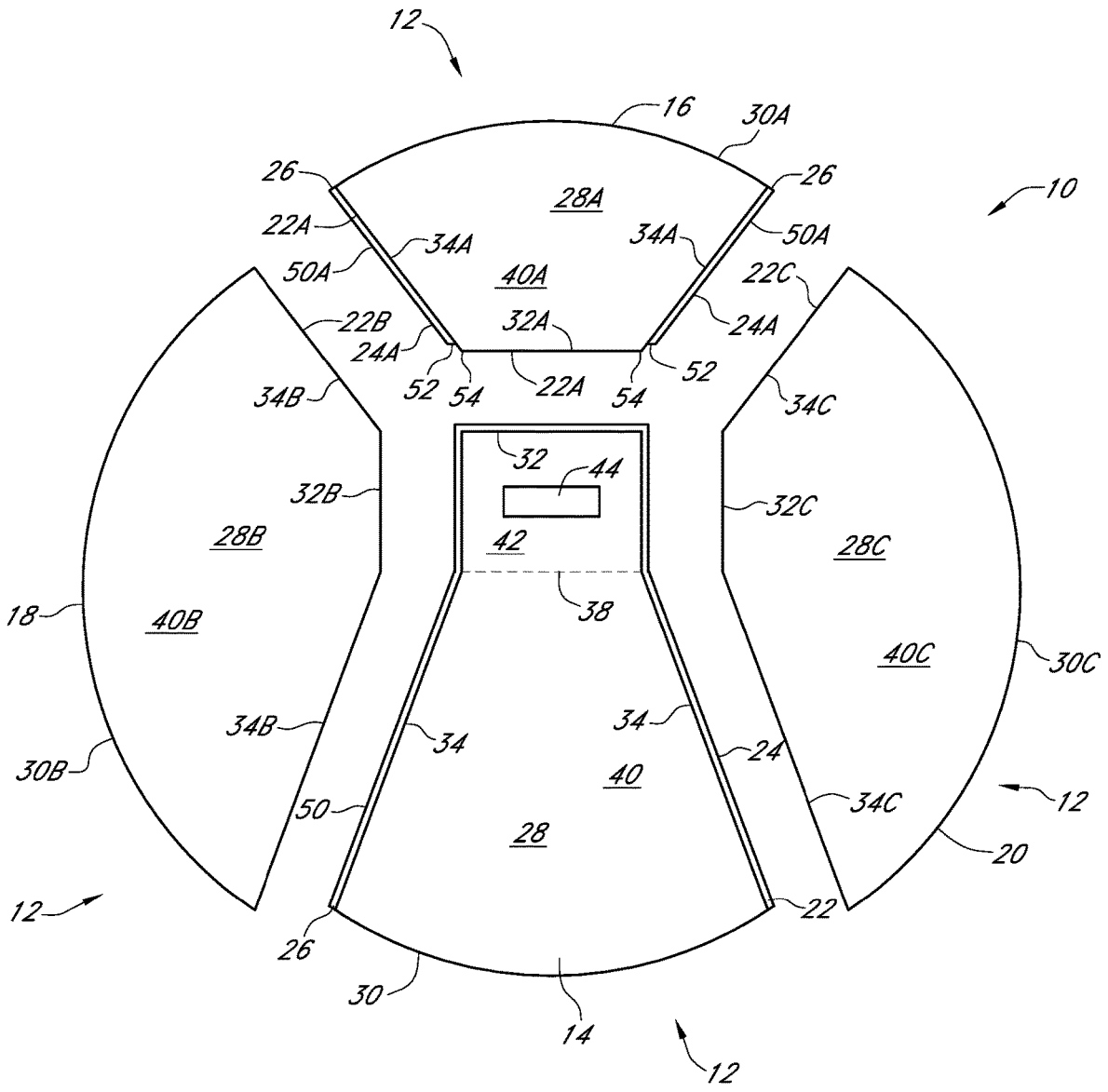
FIG. 2 is a top exploded view of a portable pitching mound.

As shown in the exemplary embodiment of FIGS. 1 and 2, the portable pitching mound 10 has four mound sections 12. The first central section 14 has a top surface 28 that extends between an outer edge or end 30 and an inner wall 32, and between a pair of side walls 34. The pair of side walls 34 extend between the outer edge 30 and the inner wall 32 and the inner wall 32 extends between the pair of side walls 34. The inner wall 32 and the pair of side walls 34 also extend between the top surface 28 and the lower edge 22 of the inner wall 32 and the pair of side walls 34. In this way, the lower edge 22 and the outer edge 30 engage a ground surface 36 when the portable pitching mound 10 is assembled for use.

As depicted in the exemplary arrangement, the outer edge 30 is arcuate in shape. The top surface 28 angles upwardly and inwardly from the outer edge 30 to a transition line or point 38 nearer the inner wall 32 such that a sloped region or portion 40 is formed. From the transition line 38 to the inner wall 32, the top surface 28 extends along a horizontal plane thereby forming a flat region or portion 42 of the top surface 28. In some embodiments, a pitcher's plate 44 is connected on the flat portion 42.

The pair of side walls 34 of the exemplary embodiment of FIG. 2, and other embodiments, have a first or straight section 46 that runs perpendicular or substantially perpendicularly to the inner wall 32. In some embodiments, the straight section 46 extends from the inner wall 32 to the transition line 38. The pair of side walls 34 also have an angled section 48 that extends from the straight section 46 of each of the pair of side walls 34 to the outer edge 30.

The lower edge 22 of the inner wall 32 and the pair of side walls 34 have a flange or lip 50 that extends upwardly and outwardly away from the lower edge 22 to form the receiving slot 24. In this way, the receiving slot 24 is positioned to the exterior of the first central section 14.

The second central section 16, as depicted in the exemplary embodiment of FIGS. 1 and 2, has a top surface 28A that extends between an outer edge or end 30A and an inner wall 32A, and between a pair of side walls 34A. The pair of side walls 34A extend between the outer edge 30A and the inner wall 32A and the inner wall 32A extends between the pair of side walls 34A. The inner wall 32A and the pair of side walls 34A also extend between the top surface 28A and a lower edge 22A of the inner wall 32A and the pair of side walls 34A. In this way, the lower edge 22A and the outer edge 30A engage the ground surface 36 when the portable pitching mound 10 is assembled for use.

The outer edge 30A of the second central section 16 is arcuate in shape and the top surface 28A angles upwardly and inwardly from the outer edge 30A to the inner wall 32A such that a sloped region or portion 40A is formed. In some embodiments, the pair of side walls 34A extend inwardly from the outer edge 30A to the inner wall 32A.

The lower edge 22A of the pair of side walls 34A have a receiving slot 24A formed by a flange 50A. In this way, the receiving slot 24A is positioned to the exterior of the second central section 16. In this embodiment, as exemplified by FIG. 2, the inner wall 32A of the second central section 16 does not have a receiving slot 24 and instead terminates at the lower edge 22A.

To assemble the first central section 14 and the second central section 16, the lower edge 22A of the inner wall 32A of the second central section 16 is inserted into and received in the receiving slot 24 extending from the inner wall 32 of the first central section 14. To facilitate assembly, a notch or cut out 52 is formed in a lower or bottom corner 54 where each of the pair of sidewalls 34A and the side wall 32A converge on the second central section 16. Likewise, in some embodiments, the receiving slot 24A on the pair of side walls 34A terminates at the notch 52. The notch 52 permits the lower edge 22A of the inner wall 32A to set within the receiving slot 24 of the first central section 14 when assembled without the connection being prevented or inhibited due to engagement with the pair of side walls 34A and receiving slot 24A of the second central section 16. This arrangement also provides for the receiving slot 24 of the first central section 14 to run substantially continuously with the receiving slot 24A of the second central section 16. While the preceding has been described in relation to a particular arrangement, the portable pitching mound 10 is contemplated in relation to any variety of portable pitching mounds 10 having at least a pair of the mound section 12.

Figure 9:
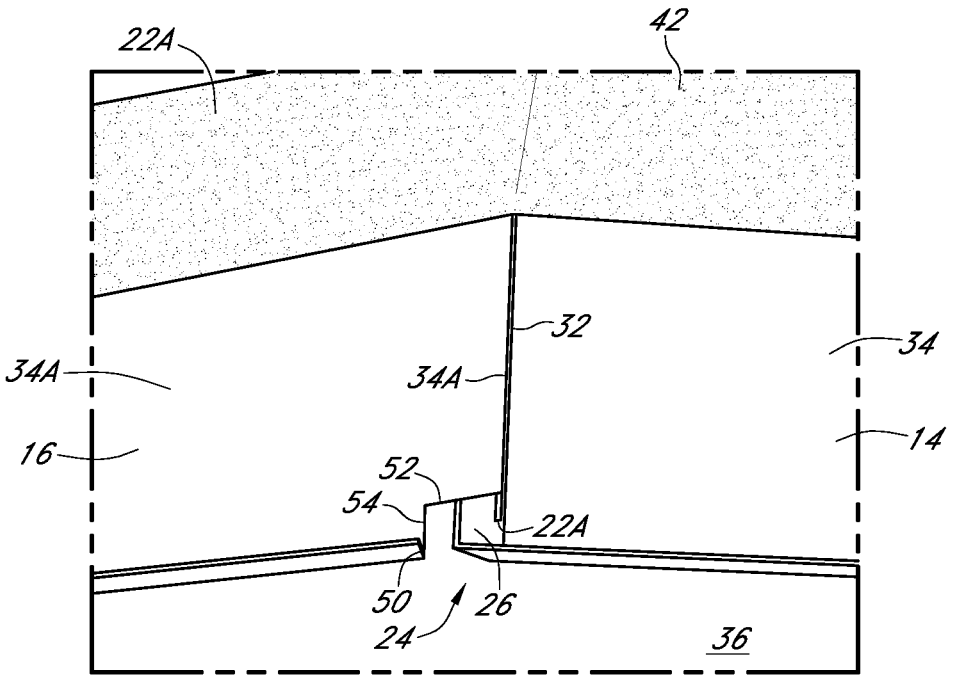
FIG. 9 is a perspective view of a portable pitching mound.

The presence of a continuous or substantially continuous receiving slot (24 and/or 24A) around two or more surfaces (e.g., the sidewall 34 and the inner wall 32 of FIG. 9) of the mound section 12 provides a number of unique advantages. Among these are increasing the rigidity of the receiving slot 24 extending from the adjacent side of the mound section 12. This is due to the transition in the direction of the receiving slot 24 that prevents or inhibits the receiving slot 24 from extending outwardly in only one direction which can result in the receiving slot 24 being damaged or broken during assembly, disassembly, or transport as the receiving slot 24 can flex or distort to greater extent in comparison to instances where the receiving slot 24 extends around multiple surfaces of the mound section 12. Additionally, a continuous or substantially continuous receiving slot 24 provides the unique advantage of simplifying manufacture as the risk of damaging or breaking the receiving slot 24 is reduced or eliminated for similar reasons set forth above. In a similar vein, the continuous or substantially continuous receiving slot 24 reduces the complexity of preparing a mold to form the portable pitching mound 12. Still further, the continuous or substantially continuous receiving slot 24 facilitates assembly of the portable pitching mound 10 as alignment and connection of the mound sections 12 is easier due to the receiving slot 24 covering a larger portion of the mound section 12 edge.

In alternative embodiments, the arrangement is reversed such that the lower edge 22 of the inner wall 32 of the first central section 14 is received in the receiving slot 24A of the second central section 16.

The first side section 18, as shown in the exemplary embodiment of FIGS. 1 and 2, also has a top surface 28B that extends between an outer edge or end 30B and an inner wall 32B, and between a pair of side walls 34B. The pair of side walls 34B extend between the outer edge 30B and the inner wall 32B and the inner wall 32B extends between the pair of side walls 34B. The inner wall 32B and the pair of side walls 34B also extend between the top surface 28B and the lower edge 22B of the inner wall 32B and the pair of side walls 34B. In this way, the lower edge 22B and the outer edge 30B engage the ground surface 36 when the portable pitching mound 10 is assembled for use.

As depicted in the exemplary arrangement, the outer edge 30B is arcuate in shape. The top surface 28B angles upwardly and inwardly from the outer edge 30B to the inner wall 32B such that a sloped region or portion 40B is formed. In some embodiments, the pair of side walls 34B extend inwardly from the outer edge 30B to the inner wall 32B. To facilitate assembly, the angle of the inner wall 32B and the pair of side walls 34B are such that they align with one side of the first central section 14 and the second central section 16. The lower edge 22B of the pair of side walls 34A do not have a receiving slot 24 and instead terminate at the lower edge 22B.

Figure 3:
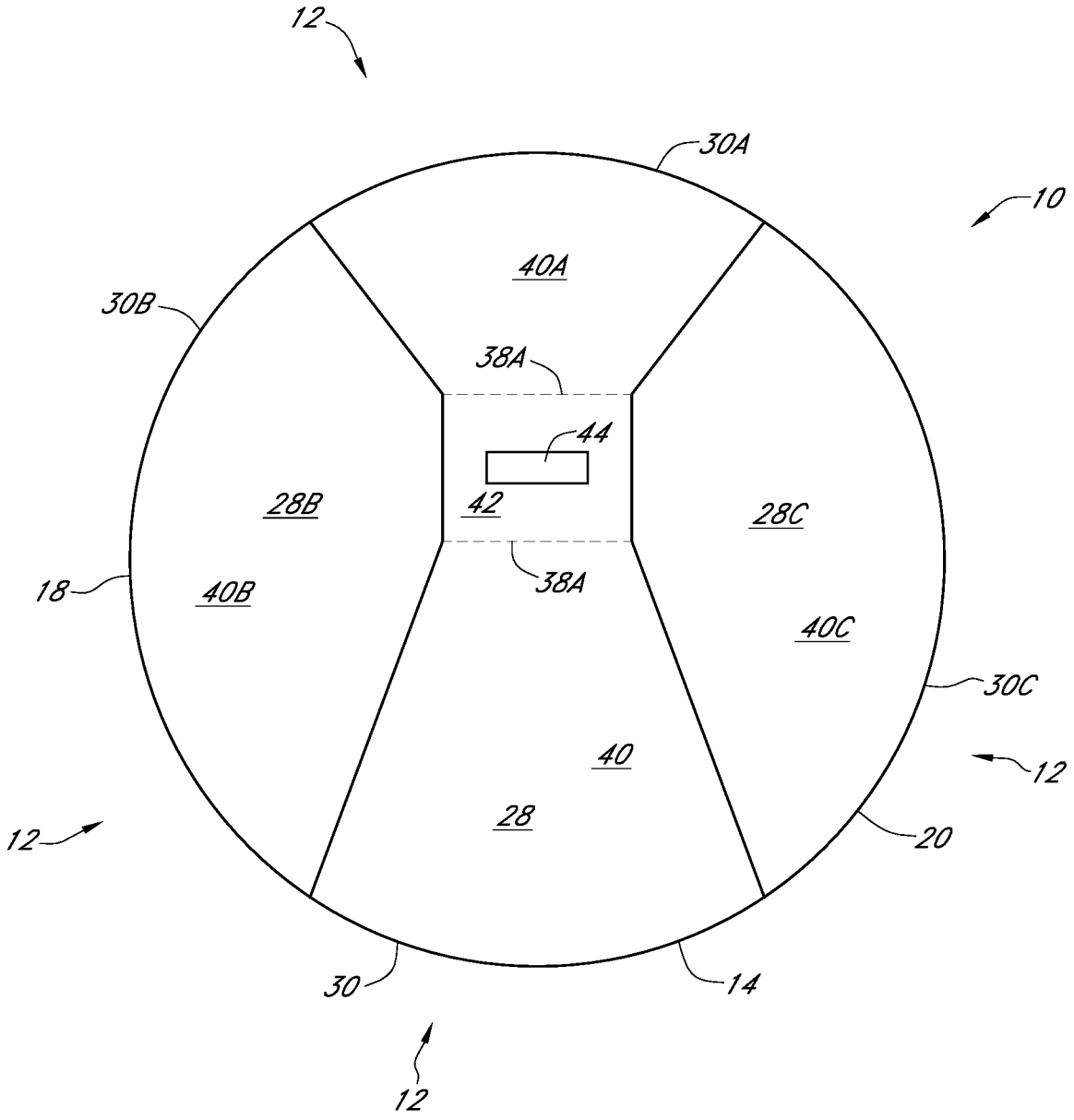
FIG. 3 is a top plan view of a portable pitching mound.

While the exemplary arrangement includes a circular shape being formed upon assembly, any variety of shapes are contemplated. Among these are variations in shape formed by the exclusion of one or more mound sections 12 as disclosed herein (e.g., the exclusion of one of the second central section 16, the first side section 18, and/or the second side section 20 as seen in FIGS. 2 and 3) or the complete assembly of any number of mound sections 12 with one another. In some particular aspects, the portable pitching mound 10 forms a hemispherical, semicircular, elliptic, rectangular, square, trapezoidal, triangular, and irregular shape or portion thereof when assembled, including in such aspects where only a single or a pair of mound sections 12 are used.

To assemble the first side section 18 with first central section 14 and the second central section 16, the lower edge 22B of the first side section 18 is inserted into and received in the receiving slot 24 and receiving slot 24A along one of the pair of side walls 34 and 34A of the first central section 14 and the second central section 16, respectively. To facilitate assembly, a notch or cut out 52 is formed in the lower edge 22B of the first side section 18, which permits the lower edge 22B to set within the respective receiving slots 24 and 24A without the connection being prevented or inhibited due to engagement between the lower edge 22B and the receiving slot 24A of the first central section 14.

As seen in the exemplary embodiment of FIGS. 1 and 2, the second side section 20 has a nearly identical structure and arrangement of the first side section 18 except mirrored, including a top surface 28C, an outer edge 30C, an inner wall 32C, a pair of side walls 34C, and a notch 52 along the lower edge 22C. Similarly, the assembly of the second side section 20 with the first central section 14 and the second central section 16 is accomplished by inserting the lower edge 22C of the second side section 18 into the receiving slot 24 and receiving slot 24A along one of the pair of side walls 34 and 34A of the first central section 14 and the second central section 16, respectively.

In alternative embodiments, the arrangement is reversed such that the lower edge 22A of the first central section 14 and the lower edge 22A of the second central section 16 are received in the receiving slot 24 extending from first side section 18 and the second side section 20.

When fully assembled, the first central section 14, the second central section 16, the first side section 18, and the second side section 20 form the portable pitching mound 10 with a circular shape due to the arcuate outer edges 30, 30A, 30B, and 30C.

Figure 4:
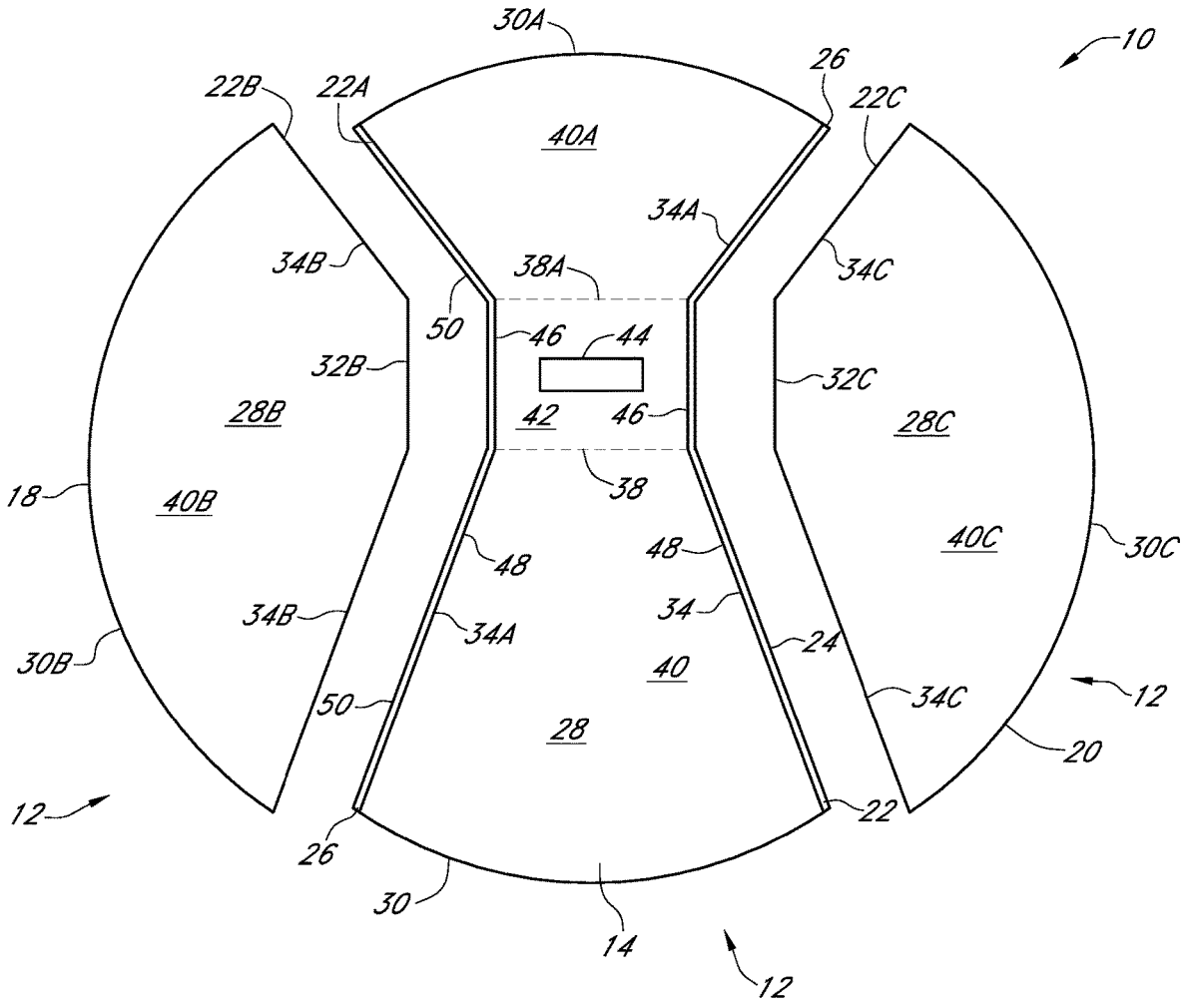
FIG. 4 is a top exploded view of a portable pitching mound.
Figure 5:
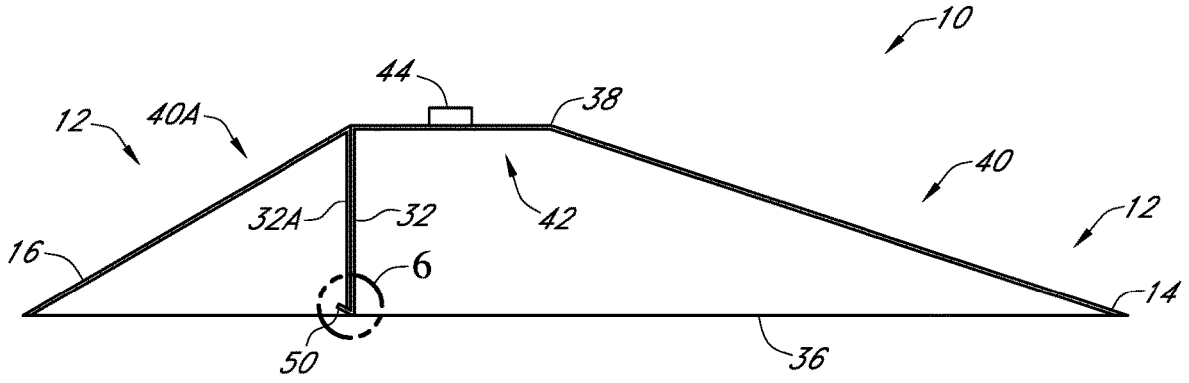
FIG. 5 is a side cross-sectional view of a portable pitching mound along line 5 of FIG. 1.
Figure 6:
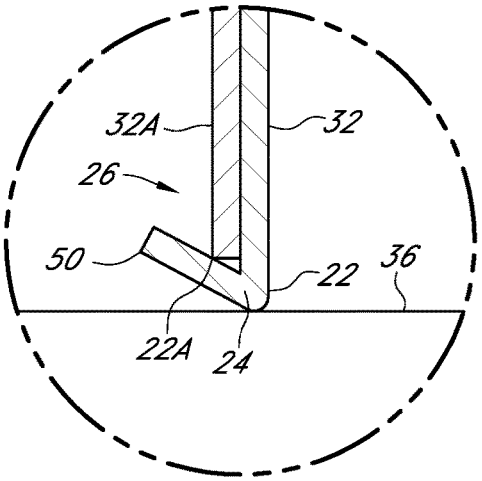
FIG. 6 is a cross-sectional view of a connection between mound sections of a portable pitching mound.
Figure 7:
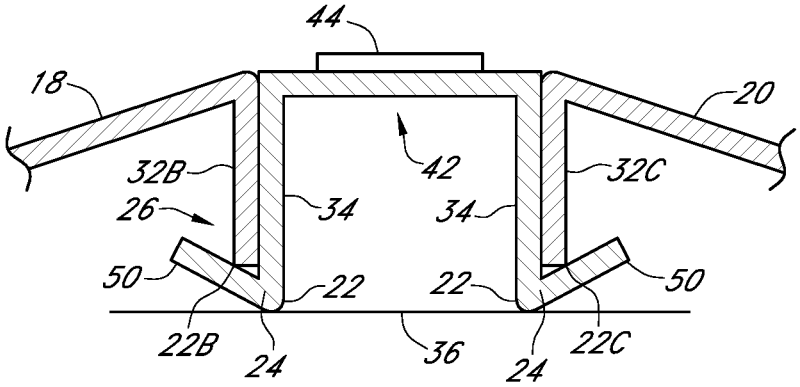
FIG. 7 is a cross-sectional view of a connection between mound sections of a portable pitching mound.
Figure 8:
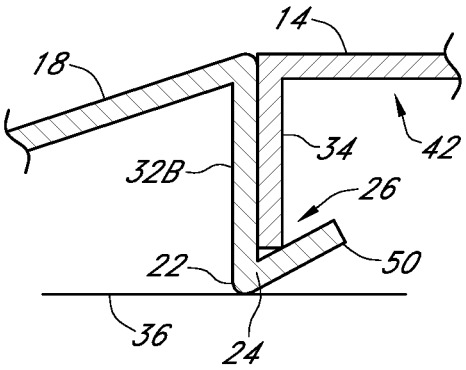
FIG. 8 is a cross-sectional view of a connection between mound sections of a portable pitching mound.

In the alternative embodiment, depicted in the example of FIGS. 3 and 4, the portable pitching mound 10 has three mound sections 12. In this arrangement, the first central section 14 and the second central section 16 are monolithically structured such that there is no need for assembly of a first central section 14 and second central section 16 with respective inner walls 32 and 32A. Rather, in arrangements of this nature, the central section 14 extends between a pair of outer edges 30 and 30A. The top surface 28 of the central section 14 has a similar configuration as the four-mound section 12 embodiment, including the presence of the slope portion 40 and the flat portion 42. In this exemplary embodiment, the top surface 28 angles upwardly and inwardly from the outer edge 30A to a second transition line or point 38A such that a second sloped region or portion 40A is formed. Between the transition lines 38 and 38A the top surface 28 extends along a horizontal plane thereby forming the flat region or portion 42 of the top surface 28.

To further facilitate assembly of the portable pitching mound 10, the plurality of mound sections 12 are monolithically formed from a one-piece construction or mold. This further negates the need for connection members or tools to accomplish the present invention. In some embodiments, the portable pitching mound 10 is molded from fiberglass to further simplify manufacturing while maintaining a durable structure that is also lightweight.

Therefore, a portable pitching mound 10 has been provided that is easy to assemble, provides a connection that is easy and inexpensive to manufacture, and improves upon the art.

From the above discussion and accompanying figures and claims it will be appreciated that the portable pitching mound 10 offers many advantages over the prior art. It will be appreciated further by those skilled in the art that various other modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. A portable pitching mound comprising:

a first mound section having an at least one side wall having a receiving slot that extends outwardly and upwardly from the at least one side wall;

a second mound section having an at least one side wall with a lower edge, wherein the second mound section is connected to the first mound section by placing the lower edge of the second mound section within the receiving slot of the first mound section; and the receiving slot extending continuously around an entirety of the at least one sidewall and an inner wall from a lower edge of the first mound section.

2. The mound of claim 1 wherein the first mound section is a central section.

3. The mound of claim 1 wherein the second mound section is a second central section.

4. The mound of claim 1 wherein the first mound section is a side section.

5. The mound of claim 1 wherein the at least one side wall of the first mound section has a straight section and at least one angled section that angles outwardly from the straight section; and a top surface of the first mound section has a flat portion and a sloped portion.

6. The mound of claim 1 wherein the receiving slot extends at an angle such that the receiving slot forms an opening that is larger than the lower edge of the second mound.

7. The mound of claim 1 further comprising the receiving slot having an angle that causes the lower edge of the second mound section to slide down the receiving slot such that the first mound section and the second mound section are brought together.

8. The mound of claim 1 further comprising a lower corner of the second mound section having a notch.

9. A portable pitching mound comprising:

a first mound section having an at least one side wall having a receiving slot that extends outwardly and upwardly from at least one side wall;

a second mound section having an at least one side wall with a lower edge, wherein the second mound section is connected to the first mound section by placing the lower edge of the second mound section within the receiving slot of the first mound section; and the receiving slot extending continuously around the at least one sidewall and an inner wall;

wherein the at least one side wall of the first mound section has a straight section and at least one angled section that angles outwardly from the straight section; and a top surface of the first mound section has a flat portion and a sloped portion.

10. A portable pitching mound comprising:

a first mound section having an at least one side wall having a receiving slot that extends outwardly and upwardly from at least one side wall;

a second mound section having an at least one side wall with a lower edge, wherein the second mound section is connected to the first mound section by placing the lower edge of the second mound section within the receiving slot of the first mound section;

the receiving slot extending continuously around the at least one sidewall and an inner wall; and a lower corner of the second mound section having a notch.

* * * * *